US005123522A

United States Patent [19]

Comly, Jr.

[11] Patent Number: 5,123,522

[45] Date of Patent: Jun. 23, 1992

[54] SEALING HEAD BRIDGING CONVEYOR

[75] Inventor: Daniel P. Comly, Jr., Holland, Pa.

[73] Assignee: SKS Equipment Company, Ivyland, Pa.

[21] Appl. No.: 653,649

[22] Filed: Feb. 11, 1991

[51] Int. Cl.[5] ..... B65G 17/00

[52] U.S. Cl. ..... 198/779; 198/613

[58] Field of Search ..... 198/779, 787, 611, 612, 198/613; 53/556

[56] References Cited

U.S. PATENT DOCUMENTS

| | | | |
|---|---|---|---|
| 2,362,132 | 11/1944 | Haub | 198/613 X |
| 2,787,359 | 4/1957 | Gerecke | 198/613 X |
| 3,091,323 | 5/1963 | Niederer, Jr. et al. | 198/779 X |
| 3,675,760 | 7/1972 | Burrage et al. | 198/779 |
| 3,760,929 | 9/1973 | Lederer | 198/779 X |
| 4,293,064 | 10/1981 | Robinson | 198/779 |

FOREIGN PATENT DOCUMENTS

| | | | |
|---|---|---|---|
| 1382513 | 2/1964 | France | 198/779 |
| 0211211 | 9/1986 | Japan | 198/779 |
| 0224831 | 7/1985 | Netherlands | 198/779 |
| 0142189 | 3/1961 | U.S.S.R. | 198/779 |
| 0403612 | 3/1974 | U.S.S.R. | 198/779 |

*Primary Examiner*—Joseph E. Valenza
*Assistant Examiner*—James R. Bidwell
*Attorney, Agent, or Firm*—John J. Simkanich

[57] ABSTRACT

A retracting bridging conveyor is provided to bridge the space between the output edge of a packaging machine sealing head work area structure and a fixed product output conveyor. This bridging conveyor operates to position a plurality of roller rods concurrently in consecutive locations thereby bridging across the particular space while in the horizontal plane of the path of the package/product flow, whereby a motion in the direction of the output conveyor is imparted to a package entered onto it. The invention, when timing and sequencing of operations require, then withdraws the plurality of roller rods below the horizontal plane of the path of the package/product flow.

20 Claims, 6 Drawing Sheets

SEALING HEAD BRIDGING CONVEYOR

BACKGROUND OF THE INVENTION

The present invention relates to bridging conveyors used with packaging apparatus. In particular, it relates to such bridging conveyors which can be retracted from the conveying plane at times during the packaging process and which can be driven.

Often, modern day packaging machinery is designed to process an assortment of sizes, shapes and weights of product. This versatility is particularly true with newer computer controlled machinery. Packaging machinery systems usually have a sealing head area where product which had been previously wrapped can be sealed, or where product is wrapped and sealed. The sealing head area machinery is fed product by an input conveyor and wrapped product is carried away by a discharge or output conveyor.

Typically, the input and discharge conveyors are spaced from the sealing head area machinery necessitating the use of bridging conveyors therebetween. This spacing is desirable to allow access to the sealing head area machinery for changeover, maintenance and cleaning without the removal of the input and discharge conveyors. While access to the space about the seal head area machinery requires removal of the bridging conveyors, this involves much less time and work than removal of input and discharge conveyors.

Stease, U.S. Pat. No. 3,944,037, shows a retractable bridging conveyor which is stored on a large drum and can be reeled out to a desired length like a garden hose. Stease's bridging conveyor uses a separate support structure to hold his flexible multi-link side rails. The conveyor has driven rollers suspended between the multi-link side rails. These rollers are driven by driving the home or feed drum end of the roller structure and thereafter coupling each successive roller along the conveyor length with idler gears, the rollers thereby being serially, drive-connected. This link rail, roller, and idler gear structure leaves a significant gap between the bridging conveyor and a mating feed conveyor.

Suga, U.S. Pat. No. 4,144,697, shows two separate bridging conveyors. The first is an endless chain belt conveyor positioned between a supply convey and the sealing head area. A separate side engagement drive structure moves product along this first bridging conveyor.

The second Suga bridging conveyor connects his sealing head area to a discharge conveyor. This second conveyor, which is an endless chain roller conveyor, also operates as the product support medium through a wrapper folding area. The rollers of this second conveyor are spaced sufficiently apart to allow wrapper film to drop therebetween under the affects of a vacuum created below through a vacuum licensing. Unlike Stease, neither the first nor the second Suga, '697, bridging conveyors are retractable.

Suga, U.S. Pat. No. 4,841,715, shows a first bridging conveyor connecting a vacuum actuated film sweeping area to a discharge conveyor. This first bridging conveyor is a continuous chain roller conveyor of sprocket drive design.

Suga, '715, also shows a vacuum actuated film sweeping work station having a short product carrying conveyor which connects or bridges between the output of a film cutting station and the first bridging conveyor. This second bridging conveyor is also of a continuous chain roller conveyor of sprocket drive design. However, it has a short rollerless section which defines a single large gap in the roller belt assembly thereby providing a large opening for drawing film therethrough under the force of a vacuum from below. This second bridging conveyor is a modification of the second bridging conveyor shown previously by Suga in the '697 patent.

Michels, U.S. Pat. No. 4,180,962, shows an automatic wrapping machine which utilizes a chain roller film sweeping device. This film sweeping device is implemented by chain roller assembly of sprocket drive design. However, contrary to the Suga, '715, conveyor, Michels has a short roller section while the larger portion of his assembly is rollerless.

The Michels', '962, device is suspended above the line of product flow. It operates to move the short roller section thereof to bridge a space between a supply conveyor and a movable roller carriage, thereby intercepting and sweeping wrapping film to a position under the product. In this operation, the short roller section of the device displaces the roller carriage which is normally positioned to abut the discharge end of the supply conveyor.

Once film is swept, other large overhead drive rollers move the product off of the roller assembly. Thereafter, the roller assembly is retracted by movement in the opposite direction.

While the Michels' roller section does in fact support product, it does not cause nor impart motion to the product.

These prior art structures are supported and driven by chain link mechanisms, or chain roller mechanisms or chain belt mechanisms. These structures have inherent in their design a "give" or "stretch" which, especially at high speeds, contributes to limitations in the accuracy of timing and sequencing of operations. Moreover, as bridging conveyors are intended to be removable, these above-described structures may require the disassembly and reassembly of many parts.

A rotating, bar rider device has been used as a bridging conveyor. This structure includes a single rotatory shaft positioned between two supports and extending transversely across a space between the output plate of a packaging machine sealing head area and a discharge or output conveyor. This device is generally more rugged and capable of more precise drive timing and sequencing operations than the other prior art described above.

The rotating bar rider conveyor includes a curved plate attached to and positioned outwardly from the rotating shaft. This curved plate extends parallel to the longitudinal axis of the shaft for a length equal to the width of the space to be bridged by the bridging conveyor. This curved plate also extends in an arc path about the shaft for a distance from about 60 to 120 degrees. As the shaft rotates, the curved plate rotates. The rotation is timed for the curved plate to intercept a package and to carry it across the space from the sealing head area to the output (discharge) conveyor. In higher speed operations, two diametrically opposed curved plates have been mounted on the shaft.

This rotating, bar rider conveyor device, like the Stease, '037, retractable bridging conveyor, is limited to handling larger packages or product. Smaller packages or product tend to fall and/or become trapped in the space between the discharge edge of the sealing head area apparatus and the beginning of the bar rider bridging conveyor curved plate, which operates as the product support surface.

Therefore, it is desirable to provide a simple, rugged and accurately timed bridging conveyor which is easily disassembled and reassembled. This bridging conveyor needs to fill the entire space from the discharge edge of the sealing head area apparatus to the adjacent end of an output (discharge) conveyor and thereby eliminate any small spaces where small packages can fall and/or become trapped. It is further desirable that this bridging conveyor impart motion to a product or package which enters onto the bridging conveyor.

SUMMARY OF THE INVENTION

An object of the present invention is to provide a bridging conveyor which more completely bridges the space between the output plate of a packaging machine sealing head area and the end of the adjacent output or discharge conveyor.

A second object of the present invention is to provide such a bridging conveyor to be of rugged design and which is easily removed from its installed position and reassembled thereinto.

A further object of the present invention is to provide a drive for such a bridging conveyor which will impart a motion to a product or package entered onto it.

Another object of the present invention is to provide such a bridging conveyor where the product or package support and conveying surface thereof can be retracted from the path of product flow and then can be repositioned thereinto.

The objects of the present invention are achieved in bridging conveyor installed to fill the space between the output plate of a packaging machine sealing head and an adjacent output conveyor.

This bridging conveyor includes a drive shaft which is supported transversely across the product flow line and below the product path. This shaft is driven from an external motor or drive mechanism. The rotation and speed of rotation of this drive shaft is controlled in synchronism with the operation of the packaging machine sealing head and in relation to the size of the packages handled.

A pair of cages are mounted, one each, adjacent either end of the drive shaft and outside the product path. Each cage is caused to rotate in a vertical, orbit plane into and out of the horizontal plane of the path of package/product flow.

A plurality of roller bars are supported between the cages and move in an orbital plane with the movement of the cages. Each roller bar is retained by each cage in an individual pathway or slot which allows the rod to be displaced in reciprocatory manner.

A cam structure is positioned adjacent each case to co-act with each roller bar thereby causing a displacement of that roller bar along its individual pathway or slot. The movement of each roller bar in the orbital plane causes that roller bar to contact and move over the cam structure whereby the specific vertical and horizontal movement of that roller bar is achieved.

A friction drive may be employed to rotate each individual roller bar about its own longitudinal axis. A cushioning mechanism may also be employed between the individual rod ends and the cam structure bearing surface.

A separate guide may further be used to assure the alignment of the plurality of individual roller rods into the horizontal plane of the path of package/product flow.

The friction drive and cushioning mechanisms can be implemented with rubber bushings positioned adjacent each end of each roller bar. These rubber bushings ride on the cam structure.

Alternatively, to the single cage structure recited above, a pair of diametrically positioned identical cages can be utilized on each side of the package/product flow path. These cages are diametrically mounted on the drive shaft.

DESCRIPTION OF THE DRAWINGS

The features, advantages and operation of the present invention will be better understood from a reading of the following Detailed Description of the Invention, in conjunction with the following drawings, in which like numerals refer to like elements and in which.

DETAILED DESCRIPTION OF THE INVENTION

Figure 1B:
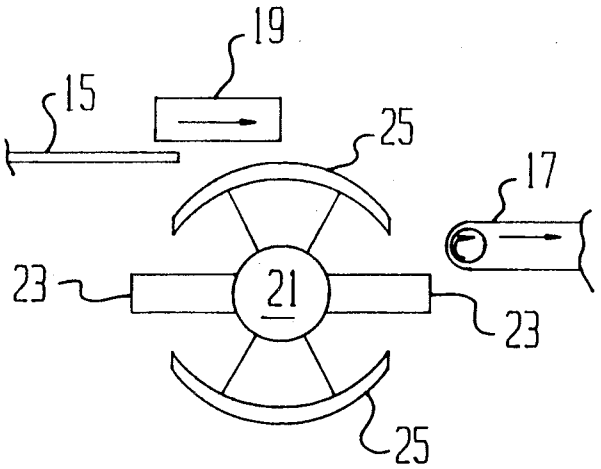
FIG. 1b PRIOR ART
FIG. 1*b* is a side view block diagram of the operation of the bar rider conveyor of FIG. 1*a* showing two bar rider members.
Figure 1A:
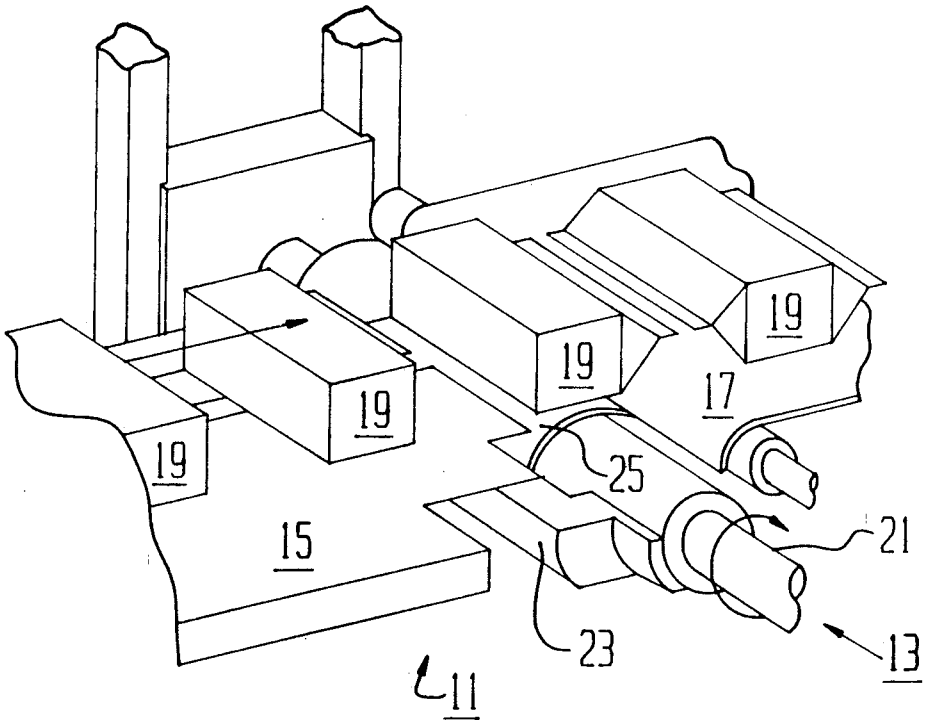
FIG. 1a PRIOR ART
FIG. 1*a* is a partially cutaway perspective view of a prior art bar rider bridging conveyor.

Packaging machines with sealing head areas 11, FIG. 1*a* have in the past utilized a bar rider type bridging conveyor 13 to bridge the gap between a fin seal top plate 15 of the sealing head area of the packaging machine and an output or discharge conveyor 17 as shown in FIG. 1*a*. This bar rider bridging conveyor 13 supports product or packages 19 as they pass over the space between the fin seal top plate 15 and the output conveyor 17.

Horizontal wrapping machines typically have used this bar rider conveyor 13 to convey product from the fin seal top plates 15 across the die end sealing head 23 space and onto the discharge conveyor. While the bar rider curved plate 25 mounted to the lower sealing bar drive shaft 21, and it provides support and drive for products 19 through the sealing head area. It presents the following disadvantages: 1. Short products 19 cannot be reliably transported because they stumble in gaps between supporting fin seal top plate 15, bar rider pate 25 and discharge conveyor 17. 2. Certain product size and sealing head diameter combinations result in bar rider surface speeds less than product flow speeds. Both of these conditions cause products to stumble or stall getting the product flow out of time with the sealing head and causing jams.

This prior art bar rider conveyor, FIG. 1*b*, has a rotating drive shaft 21 which rotates the bar rider plate 25 and the sealing die 23. The bar rider plate 25 is an arc shaped elongate plate 25 positioned to extend along the length of the drive shaft 21. This curved plate 25 intercepts a package 19, as shown in FIG. 1*b*, to support the package over the space between the fin seal top plate 15 and the discharge conveyor 17, as the package is passed onto the discharge conveyor 17. The rotation of the bar rider curved plate 25 in the direction of product flow imparts a motion to the product 19.

Figure 2:
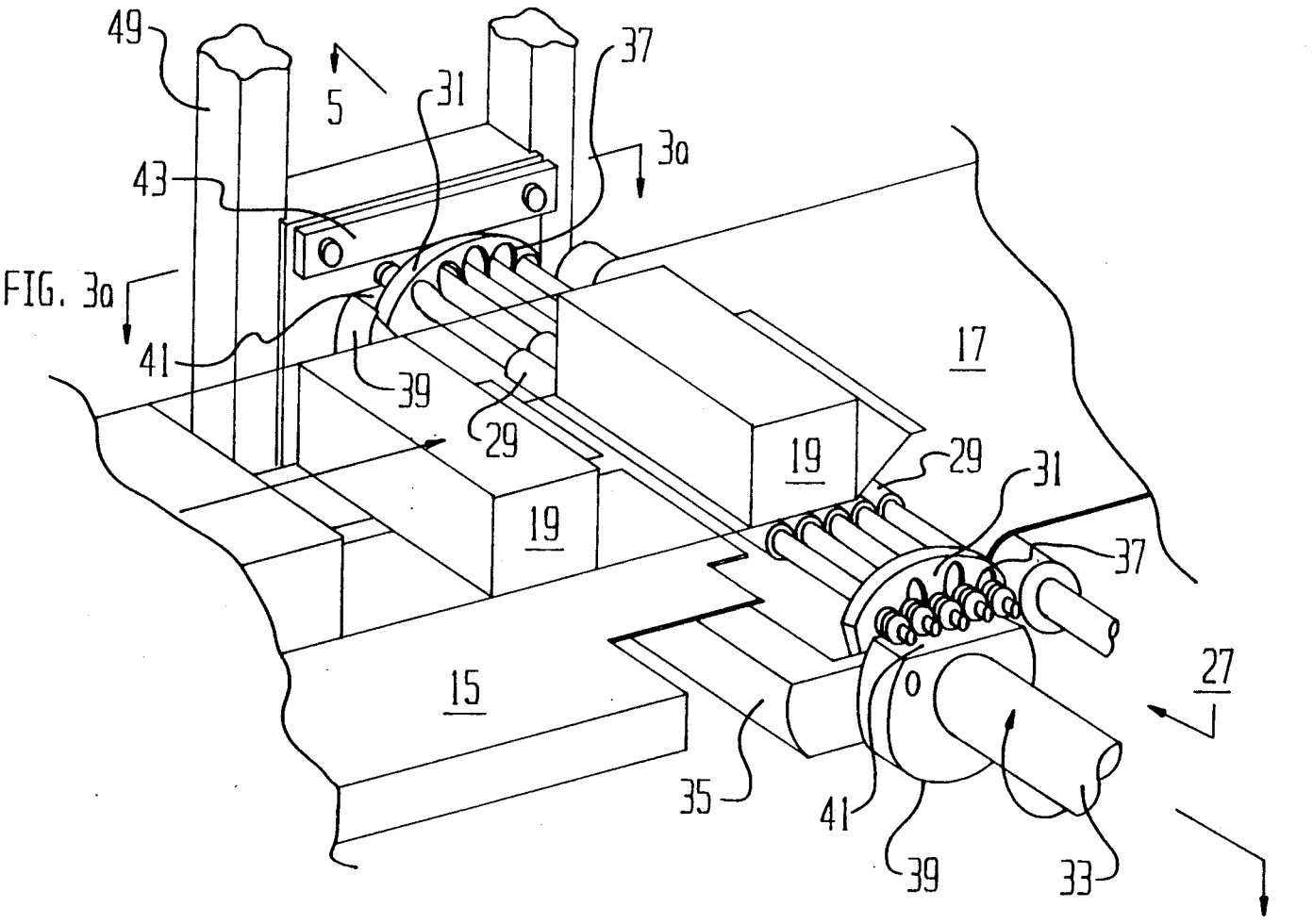
FIG. 2 is a partially cutaway perspective view of the sealing head bridging conveyor of the present invention.

The present invention, as shown in FIG. 2, likewise transports product 19 along the plane of its normal flow path across the space between the fin seal top plate 15 and the discharge or output conveyor 17 in which space a sealing die operates. This bridging conveyor assembly 27 includes a plurality of bar rollers (roller bars) 29 which form a roller bed upon which the product 19 is transferred.

These bar rollers 29 are held to form a roller carriage structure by a pair of circular or arc shaped cage members 31. Each cage 31 is made from a flat plate which extends vertically at a location outside of the path of product 19 flow.

The bridging conveyor assembly 27 includes and is driven by a drive shaft 33. This drive shaft 33 is connected to a drive, as will be described below, and is rotated in the direction of flow of the product 19.

Drive shaft 33 supports and rotates a sealing die 35. Cages 31 are each welded or otherwise attached to the drive shaft 33 to extend normally outwardly therefrom and to rotate in a circular orbital path lying in a vertical plane on either side of the product path. Each cage plate 31 contains a plurality of elongate slots 37, having parallel faces and rounded ends. These slots 37 are spaced around the cage 31 in sequential order along radial lines which extend from the central or longitudinal axis of the drive shaft 33.

A pair of fixed cams 39 are positioned, one each, on each side of the product flow path, outboard from the position of a respective cage 31. These cams 39 do not rotate and are each circular lobes which contain a flat portion or face 41 on the top side thereof. This flat portion or face 41 on each of the cams 39 establishes a caming surface against which each of the bar rollers 29 ride or are supported while in the plane of the product flow. This flat portion 41 is utilized to align the bar rollers 29 to form a roller carriage assembly for the support of the product 19 as it travels across the space between the fin seal top plate and the discharge conveyor 17.

A top guide bar 43 acts as a secondary guide member or abutment member against which the bar rollers 29 can have their vertical motion stopped. This top guide bar 43 acts as a secondary guide member to assure that the bar rollers 29 align in a flat plane or table when they are in a position immediately adjacent to the flow path of the product 19.

Figure 3B:
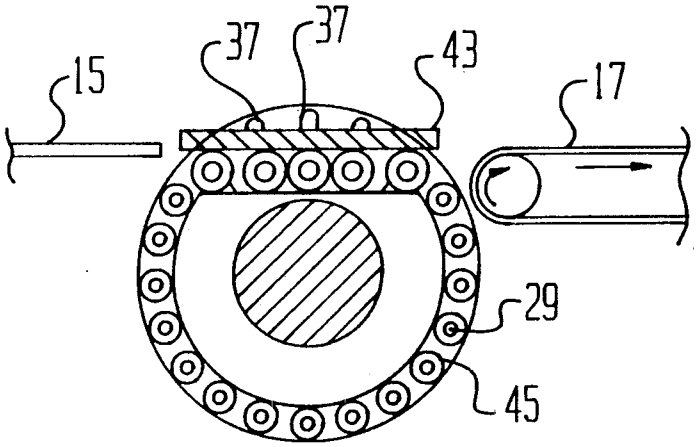
FIG. 3*b* shows an alternate embodiment for the cage of FIG. 3*a;*
Figure 3A:
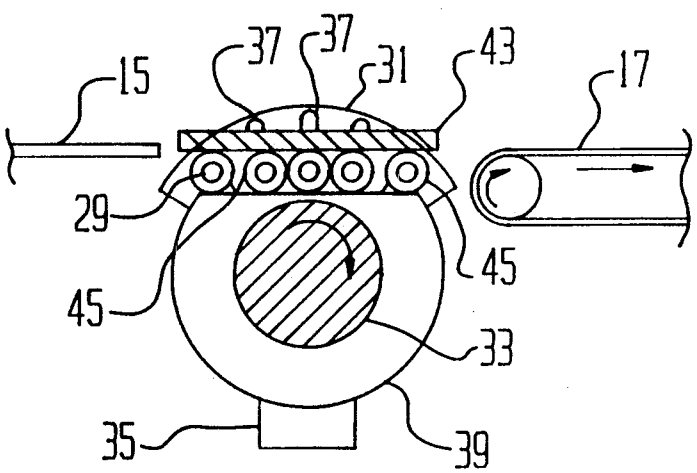
FIG. 3*a* is a side view of the cage, cam, bar rollers (roller bars) and sealing die of FIG. 2, taken as shown in FIG. 2.

A side view crossection of the interaction of the bar rollers 29, the cam 39 and the top guide bar 43 can be easily seen in FIG. 3*a*. Here, the cam 39 which is fixed, has the shaft 33 passing through the middle thereof. As the shaft 33 rotates it causes each cage 31 to rotate and transcribe a circular orbital path around the shaft 33. As the cages 31 move, they carry each of the bar rollers 29 with them. The bar rollers 29 travel an orbital path which is essentially circular except for the top portion thereof which is in a flat path parallel to the plane of the path of product flow. The sealing die 35 is oppositely positioned to the bar rollers 29.

As seen in FIG. 3*a*, each bar roller has mounted on its end a rubber bushing assembly 45. These bushing assemblies 45 are each rigidly affixed to their respective bar roller 29. The rubber bushing assemblies 45 operate as the contact member for the bearing or contact surface of each of the cams 39. As the bar rollers 29 are each caused to travel over the cam 39 lobe bearing surfaces, the rubber bushing assemblies 45 rotate causing each of the bar rollers 29 to rotate. This rotation of the bar rollers 29, like the rotation of the drive shaft 33, is in the direction of product flow.

The plates which make up the cages 31, need not be the arc shaped embodiment of FIG. 3*a*. The cages 31, alternately, can be circularly shaped as shown in FIG. 3*b*. In this embodiment, FIG. 3*b*, the bridging conveyor assembly 27 has a continuous roller bed filling the space between the fin seal top plate 15 and the discharge conveyor 17, as opposed to an intermittent roller bed as shown in FIG. 3*a*. No sealing die is shown.

In the embodiment of FIG. 3*a*, the rotation of the shaft 33 is synchronized to the speed of product flow. The rotational position of the cages 31, and the roller bed established by the bar rollers 29, is timed for rotational position to intercept a product 19 when that product enters the space between the fin seal top plate 15 and the discharge conveyor 17. This structure is particularly useful in wrapping operations where the wrapping material must be intercepted and drawn below the path of flow of the product 19 and/or the sealing die must operate.

Figure 4B:
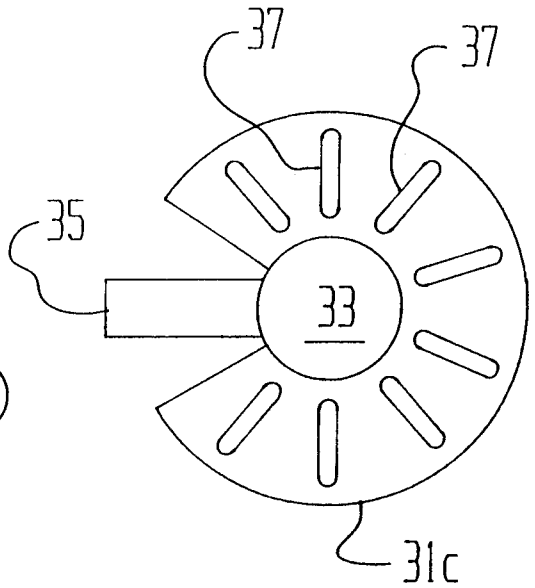
FIG. 4*b* is an elevation end view of the drive shaft, "one-up", single cam mounting, single sealing die alternative to the embodiment of FIG. 3*a*.
Figure 4A:
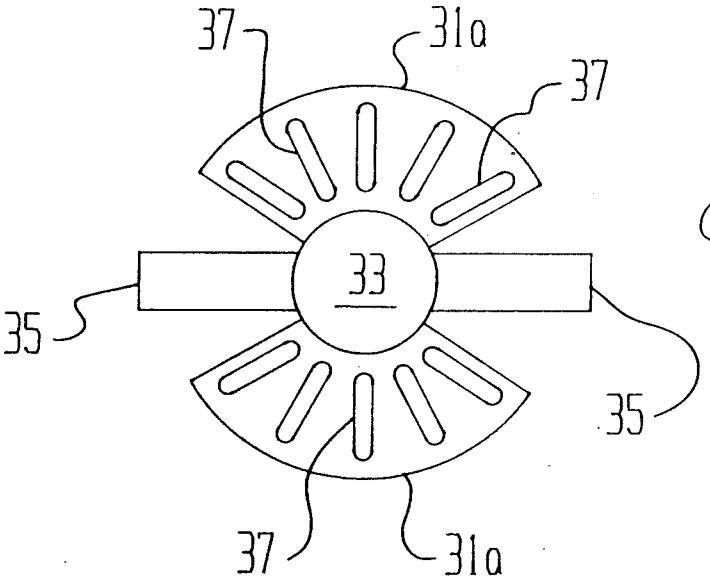
FIG. 4*a* is an elevation end view of the drive shaft, "two-up", diametrically opposed cams and two sealing dies embodiment of the invention of FIG. 2.

FIG. 4*a* shows a pair of diametrically opposed mounted arc-shaped cages 31*a* on the drive shaft 33. Each case 31*a* carries a plurality of elongate radially extending and circularly displaced slots 37. Each slot 37, like the slots described above, is identically shaped and sized. This is a "two-up" configuration for the cage structures. A pair of sealing dies 35 are utilized.

FIG. 4*b* shows a single cage 31*c* in a "one-up" configuration mounted on a drive shaft 33. This "one-up" cage 31*c* carries the slots 37 as with the other cages. A single sealing die 35 is utilized.

Figure 5:
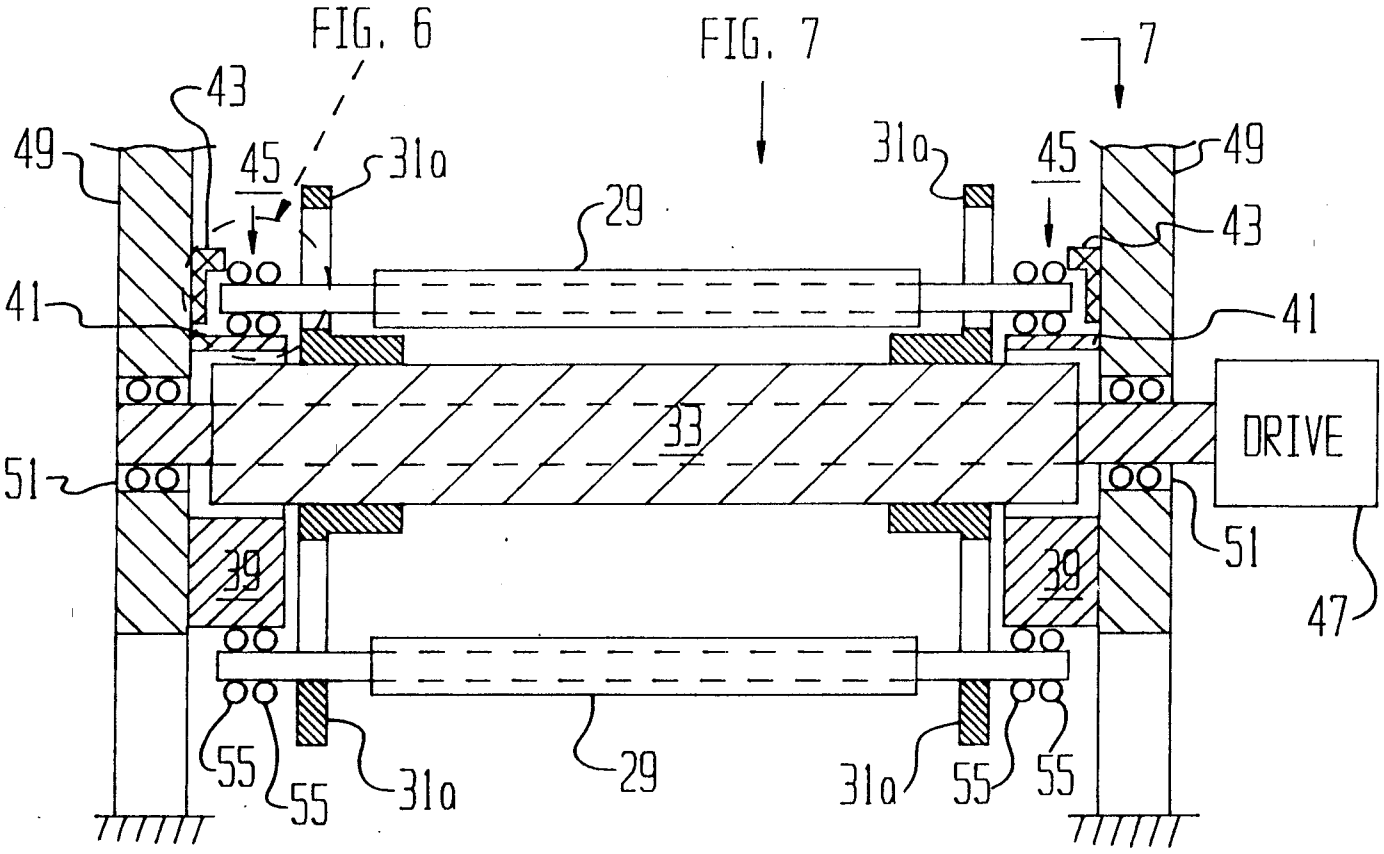
FIG. 5 is a transverse sectional elevational view of the bridging conveyor of FIG. 2, taken as shown in FIG. 2 and showing the near support stand not shown in FIG. 2.

The shaft 33, FIG. 5, can be driven by any of a number of drive mechanisms 47. A support stand 49, is positioned on each side of the bridging conveyor assembly 27 with the drive shaft 33 extending through each support stand 49. Bearings 51 of any of a number of acceptable designs may be utilized where the shaft passes through each support stand 49. The selection of these bearings 51 will depend upon the weight and speed considerations of the bridging conveyor assembly 27.

As can be seen from FIG. 5, the "two-up" embodiment of FIG. 4*a* with two diametrically opposed roller bar carriages is shown. The paired opposed cages 31*a* are mounted on the drive shaft 33 support two series of bar rollers 29. In this view, the series of bar rollers 29 on top forms the roller carriage assembly as it rides on the flat portion or face 41 of the cam 39. The series of bar rollers 29 on the bottom rides on the circularly curved portion of the cam 39.

Figure 6:
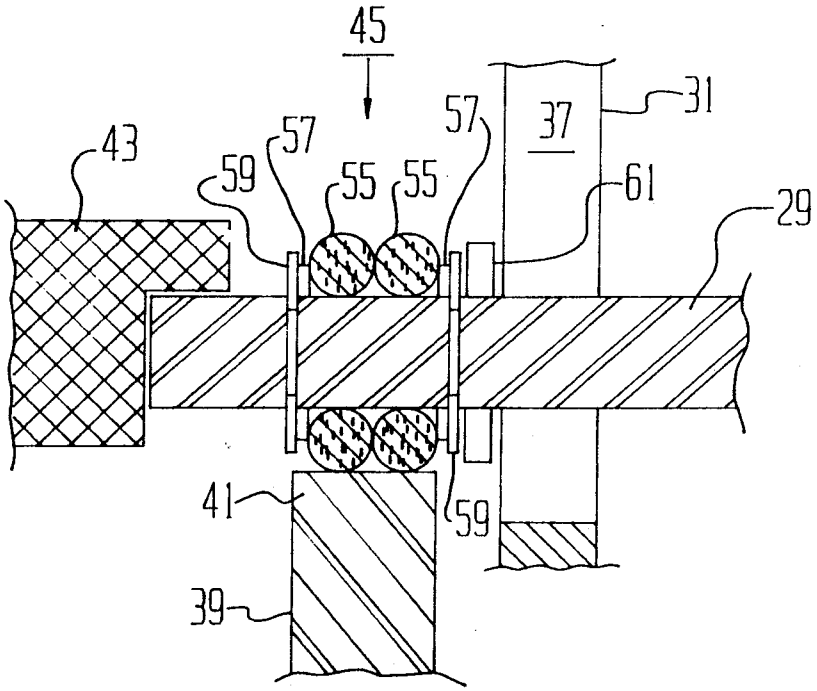
FIG. 6 is an enlarged detail of a partial crossection of FIG. 5 showing the friction drive as indicated in FIG. 5.

The rubber bushing assemblies 45 are shown in greater detail in FIG. 6. Here, a pair of rubber bushings 55 are securely mounted onto each of the bar roller 29 ends. This bar roller 29 extends through a respective slot 37 of the cage 31 (or 31*a* or 31*b*) to abut the top guide bar 43 when the rubber bushing assembly rides on the top face 41 of the cam 39.

The rubber bushing assembly 45 has the pair of frictional drive bushings 55 extending about the circumference of the bar roller 29 and securely glued or otherwise attached thereto.

These frictional drive bushings 55 ride over the cam 39 and cause the bar roller 29 to rotate. These bushings 55 are held into position and refrained from lateral distortion by a pair of outboard retaining washers 57. Each retaining washer 57 is held on the roller bar 29 by a retainer clip 59. A spacing washer 61 may be used between the inboard retaining clip 59 and the face of the cage 31. This spacing washer 61 assures that the drive bushings 55 remain centered over the cam 39.

Figure 7:
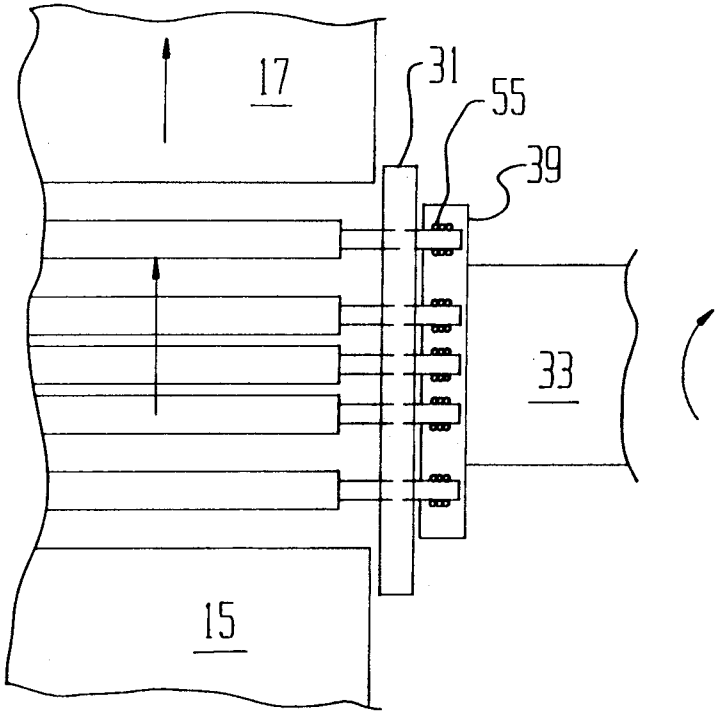
FIG. 7 is a partial top plan view of the bar rollers (roller bars), cage and a bar roller orbital path cam, taken as shown in FIG. 5.

As shown in FIG. 7, the rotation of the drive shaft 33 causes the roller assembly of the plurality of bar rollers 29 and their respective retaining cages 31 to rotate in orbit paths about the shaft 33. When the bar rollers 29 are in the plane of the product 19 flow, they are immediately adjacent to this product 19 for supporting it across the space from the fin seal top plate 15 to the discharge conveyor 17.

It is obvious from the FIGS. 2, 3*a* and 3*b* that the orbital path traveled by the cages 31 differs from the orbital path traveled by each of the bar rollers 29. However, the movement of the cages 31 and the bar rollers 29 is controlled by the speed of rotation of the drive shaft 33, whereby the speed of travel of each of the bar rollers 29 is a function of their distance from the axis of rotation of the drive shaft 33 as modified by the interaction between the radial slots 37 in the cages 31 and the bar rollers 29 traveling over the lobes of the fixed cams 39.

The present invention provides a simple drive structure with an improved control of the operation of the bar rollers 29. The design permits ease of assembly and disassembly of the bridging conveyor assembly structure 27. The movement of the bar roller 29 around the cams 39 creates a roller bed which essentially completely fills the space between the fin seal top plate 15 and the discharge conveyor 17, when the bar rollers 29 are riding on the top flat portion 41 of the cams 39.

With the present invention, the reasonably large space allowed with the prior art bar rider conveyors is essentially eliminated. Therefore, the present invention is capable of being used in packaging machine assembly lines where various sizes of packages must be handled.

The above description is intended to be illustrative of the invention. Many changes can be made in the above-described embodiments without departing from the intent or scope of the invention. These changes are intended to be incorporated as part of the present invention. The scope of the present invention, therefore, is to be defined by the claims appended hereinafter.

What is claimed is:

1. A conveyor for bridging a space between two pieces of equipment in a product flow line for conveying product from the discharge side of said first piece of equipment to the loading side of a second piece of equipment, comprising:

a drive shaft positioned in said space and below the plane of the product flow;

a plurality of bar rollers of sufficient number to bridge the space between said two pieces of equipment when in a normal spaced apart relationship for a conveyor, said bar rollers each extending transversely across the flow of product;

a retaining mechanism connected to said drive shaft and holding and moving said plurality of bar rollers, said retaining mechanism being capable of being driven by said drive shaft to position said plurality of bar rollers into said plane of the product flow and then to position them therebelow;

a plurality of bar roller guideways in said retaining mechanism and in contact with said bar rollers thereby permitting a displacement of each of said bar roller at least in a vertical direction; and a cam mechanism mounted to intersect the path of travel of said bar rollers and to guide their movement each into alignment with the plane of the product flow when said retaining mechanism positions them into said plane.

2. The conveyor of claim 1 also including a secondary drive mechanism attached to each bar roller for rotating each roller about its own longitudinal axis.

3. The conveyor of claim 2 also including a secondary guide structure mounted above said plane of the product flow to limit said vertical displacement of said bar rollers.

4. The conveyor of claim 3 wherein said drive shaft is positioned to extend transversely across said space and the line of said product flow at a location below said plane of the product flow and is coupleable to be rotated in the direction of said product flow.

5. The conveyor of claim 4 wherein said retaining mechanism includes a pair of cages mounted to said drive shaft, one on either side of the path of product flow, each said cage containing said bar roller guideways.

6. The conveyor of claim 5 wherein each said cage is a circular plate mounted to said drive shaft to rotate therewith and extending normally outwardly from the surface thereof.

7. The conveyor of claim 6 wherein each cage circular plate is an arc section plate extending a distance of from about 60 to 120 degrees and mounted to said drive shaft in alignment with said other cage arc section circular plate.

8. The conveyor of claim 7 wherein said plurality of bar roller guideways are a plurality of elongate slots in each said cage arc section circular plate extending radially outwardly along radial lines from the center line of said drive shaft, said slots in each said cage forming paired slots for holding one of said bar rollers thereby positioned to extend said bar roller transversely to and across said path of product flow and to move it in an orbital path with the movement of said cages.

9. The conveyor of claim 8 wherein said cam mechanism includes a pair of stationary cams, one each mounted on each side of said path of product flow and having said drive shaft extend rotationally therethrough, wherein portions of each end of each said bar roller contacts a respective adjacent stationary cam to ride thereagainst.

10. The conveyor of claim 9 wherein each said stationary cam is a circular lobe having a flat portion, this flat portion being parallel to said plane of the product flow whereby said bar rollers are positioned parallel to said path of product flow when in contact with said flat portion of said stationary cams.

11. The conveyor of claim 10 wherein said secondary drive mechanism is a friction drive operated by the relative orbital movement of said bar rollers and said stationary cams.

12. The conveyor of claim 11 wherein said friction drive includes a plurality of friction producing drive bushings mounted at least one on each end of each bar roller and being in contact with said respective adjacent stationary cam to ride thereagainst and to thereby rotate each bar roller on its own longitudinal axis as said drive shaft, with said cages are rotated and said bar rollers are orbited about said stationary cams.

13. The conveyor of claim 12 wherein secondary guide structure includes a pair of stationary guide bars mounted one each on either side of said path of product flow and above said plane of the product flow thereby extending parallel to said path, whereby said bar rollers can abut said stationary guide bars thereby limiting their vertical displacement and aligning them with said plane of the product flow when said bar rollers are in contact with said flat portion of said stationary cams.

14. The conveyor of claim 13 wherein said friction producing drive bushings are of a rubber-like material with a friction modulus great enough to overcome any "drag" caused by said bar rollers contacting said stationary guide bars.

15. A roller conveyor for bridging a space between two pieces of machinery, said roller conveyor being driven to impart motion to a product entered upon it along a product path between said two pieces of machinery, comprising:

a movable roller carriage positioned in said space;

a plurality of bar rollers carried in said roller carriage of sufficient number to establish a roller bed essentially completely across said space between said two pieces of machinery;

a shaft positioned in said space and extending transversely across said product path, said shaft being connectable to a drive mechanism for rotation with the direction of product flow;

wherein said movable roller carriage is connected to said shaft and caused to travel in an orbital path about said shaft as said shaft rotates; and whereby said bar rollers are caused to travel in a separate orbital path about said shaft from said roller carriage wherein the central point for rotation of said roller carriage and said bar roller is said rotating shaft.

16. The conveyor of claim 15 also including a guide mechanism for establishing a product bar roller bearing position for each of said plurality of bar rollers, this product bar roller bearing position being along a plane which is parallel to said product path, said plane defining a first flat portion of said bar roller orbital path.

17. The conveyor of claim 16 wherein the remaining portion of said bar roller orbital path is circular.

18. The conveyor of claim 17 also including a friction drive mechanism connected to each of said bar rollers and to said guide mechanism for causing said bar rollers to each rotate about their own longitudinal axis said bar roller rotation being in the direction of product flow as said bar rollers travel in their orbital path.

19. A bridging conveyor for bridging the space between the discharge edge of a fin seal plate of a packaging machine sealing head and an output discharge conveyor positioned there away from, said bridging conveyor providing a roller conveyor bed essentially filling said space and extending along the product flow path, comprising:

a drive shaft mounted in said space below said product flow path and transversely thereacross;

a pair of cages mounted on said drive shaft on opposite sides of said product flow path and orbit upon the rotation of said drive shaft;

a plurality of roller bars carried between said cages and connected thereto so as to orbit therewith, these roller bars forming said roller conveyor bed; and a guide structure having an attachment to said cages and being in contact with said roller bars, said guide structure causing said orbital path of said roller bars to have a circular portion and a flat portion, said flat portion being in parallel with said product flow path and immediately adjacent the plane of said product flow.

20. The bridging conveyor of claim 19 wherein said guide structure includes:

a plurality of slots carried in each cage extending sequentially along successive radial lines extending outwardly from the longitudinal axis of said drive shaft, wherein a corresponding slot in each cage is dedicated to retain a single roller bar;

at least one cam member extending about said drive shaft and positioned to be in contact with each roller bar and thereby to guide the orbital travel thereof; and at least one abutment bar extending adjacent the plane of said product flow and above thereof, said abutment bar restraining the position of each said roller bar while said roller bar is immediately adjacent the plane of said product flow.

* * * * *